US005884614A

United States Patent [19]

Darlington et al.

[11] Patent Number: 5,884,614

[45] Date of Patent: Mar. 23, 1999

[54] CROSSBOW WITH IMPROVED TRIGGER MECHANISM

[75] Inventors: Rex F. Darlington, Whittemore; Scott H. Phillips, East Tawas, both of Mich.

[73] Assignee: Container Specialties, Inc., Hale, Mich.

[21] Appl. No.: 933,809

[22] Filed: Sep. 19, 1997

[51] Int. Cl.[6] ..... F91B 5/12

[52] U.S. Cl. ..... 124/25; 124/35.1

[58] Field of Search ..... 124/25, 40, 35.1, 124/35.2

[56] References Cited

U.S. PATENT DOCUMENTS

| | | | |
|---|---|---|---|
| 4,192,281 | 3/1980 | King | 124/25 |
| 4,693,226 | 9/1987 | Simonde et al. | 124/25 |
| 4,877,008 | 10/1989 | Troubridge | 124/25 |
| 5,085,200 | 2/1992 | Horton-Corcoran et al. | 124/25 |
| 5,596,976 | 1/1997 | Waiser | 124/25 |
| 5,598,829 | 2/1997 | Behnar | 124/25 |
| 5,619,979 | 4/1997 | Ossege | 124/25 |
| 5,649,520 | 7/1997 | Bednar | 124/25 |

*Primary Examiner*—John A. Ricci

*Attorney, Agent, or Firm*—Barnes, Kisselle, Raisch, Choate, Whittemore & Hulbert, P.C.

[57] ABSTRACT

A crossbow that includes a barrel having a pair of limbs and a bowstring cable that extends between the limbs, a trigger mechanism for selectively capturing and releasing the bowstring cable against flexure of the limbs, and a guide for supporting a bolt on the barrel when the cable is captured by the trigger mechanism. The trigger mechanism in the preferred embodiment of the invention includes a latch mounted for pivoting between a closed position in which the latch captures the cable and an open position for releasing the cable. A latch release arm is mounted adjacent to and in opposed engagement with the latch. The upper surface of the latch release arm engages the latch for releasably holding the latch in both the open and closed positions. A trigger linkage operatively couples a trigger to the latch release arm to release the latch release arm from holding the latch in the closed position, so that force of the cable against the latch pivots the latch and the latch release arm from the closed to the open positions so as to release the cable and fire the bow.

18 Claims, 4 Drawing Sheets

CROSSBOW WITH IMPROVED TRIGGER MECHANISM

The present invention is directed to crossbows, and more particularly to an improved crossbow trigger mechanism with a dry-fire safety feature.

BACKGROUND AND SUMMARY OF THE INVENTION

Crossbows conventionally include an elongated barrel of wood, metal or composite composition that essentially forms a mounting base for the remainder of the crossbow hardware. A pair of resilient limbs of wood or composite composition project in opposite directions from one end of the barrel, with the free ends of the limbs being joined by a bowstring cable. A support is provided on the upper surface of the barrel for holding a bolt. A trigger mechanism is carried by the barrel for engaging and holding the bowstring cable in the drawn or cocked position, and for selectively releasing the cable so as to propel the bolt from the bow.

It is a general object of the present invention to provide an improved trigger mechanism that is characterized by a long power strike, improved balance and a reduced number of component parts, which in turn reduces manufacturing and repair costs, that obtains smooth trigger action as the bowstring cable is both latched, that exhibits no change in pressure as the trigger is squeezed and the bolt is released, that includes a dry-fire safety feature to prevent release of the bowstring cable if there is no bolt in the bow, and/or that includes an operator safety for selectively preventing firing of the bow. It is another object of the present invention to provide a crossbow in which the trigger and safety are disposed and configured in a manner analogous to conventional rifles.

The trigger mechanism in accordance with the presently preferred embodiment of the invention includes a latch mounted on the barrel for pivoting between a closed position in which the latch captures the bowstring cable in the drawn position, and an open position for releasing the cable against flexure of the limbs. A latch release is mounted adjacent to and in opposed engagement with the latch for engaging the latch releasably to hold the latch in both the open and closed positions. A trigger linkage operatively couples a trigger to the latch release, and is responsive to movement of the trigger by an operator to release the latch release from holding the latch in the closed position, such that the force of the bowstring cable against the latch pivots the latch and the latch release from the closed to the open positions of these components so as to release the cable.

A dry-fire safety is carried as part of the trigger mechanism for engaging the bowstring cable so as to prevent release of the bowstring cable when a bolt is absent from the bolt support on the stock in engagement with the cable. The dry-fire safety in the preferred embodiment of the invention comprises a spring-biased safety latch disposed in opposition to the bolt support on the stock immediately adjacent to the cable latch. Placement of a bolt on the bolt support in engagement with a drawn cable biases the safety latch upwardly against the safety latch spring so as to permit passage of the bowstring cable and the bolt when the trigger is released. In the absence of a bolt on the bolt support, the safety latch blocks passage of the bowstring cable when the trigger mechanism is released.

In the preferred embodiment of the invention, the cable latch, the latch release and the dry-fire safety are carried within a trigger housing that is mounted on the barrel. The trigger linkage mechanism extends into the housing, and terminates within the housing in a sear pin in engagement with the latch release. The opposing end of the trigger linkage is disposed adjacent to an operator safety slide carried by the barrel. A pin on the trigger linkage is biased by a spring into engagement with channels in the safety slide for resiliently holding the safety slide in blocking and releasing positions of the safety slide. A land on the safety slide is disposed either opposed to or spaced from the end of the trigger linkage for either blocking movement of the trigger linkage and release of the bowstring cable, or permitting movement of the trigger linkage and release of the bowstring cable, depending upon position of the safety slide.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
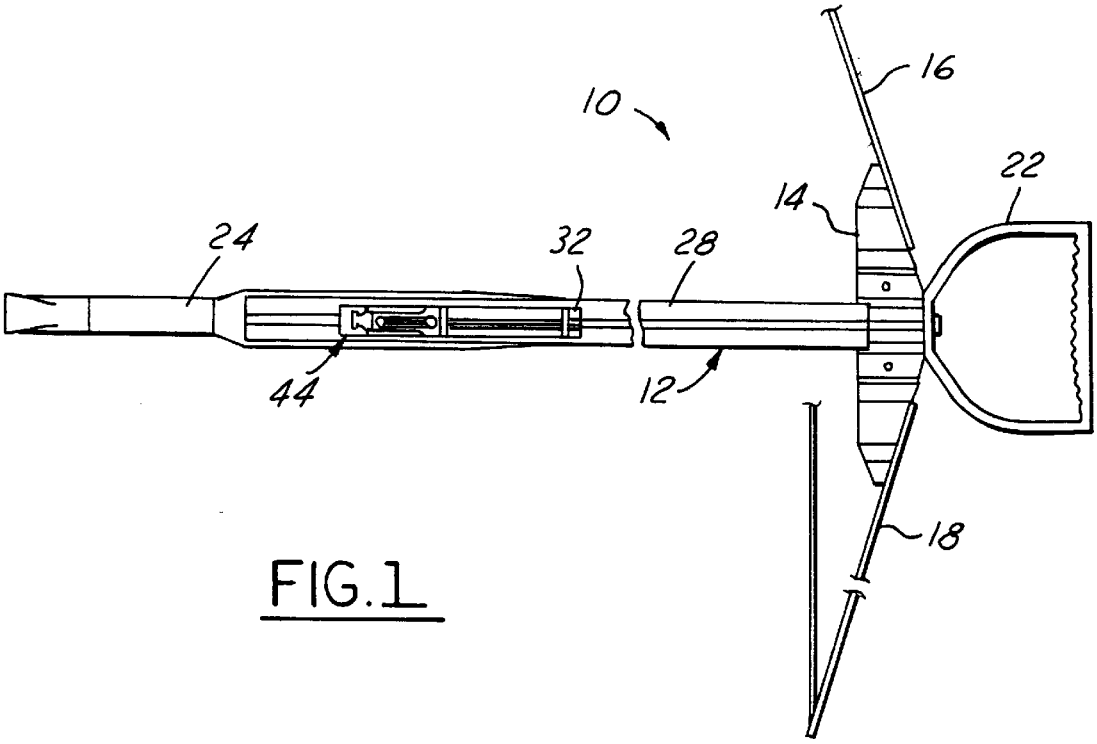
FIG. 1 is a top plan view of a crossbow in accordance with a presently preferred embodiment of the invention.
Figure 2:
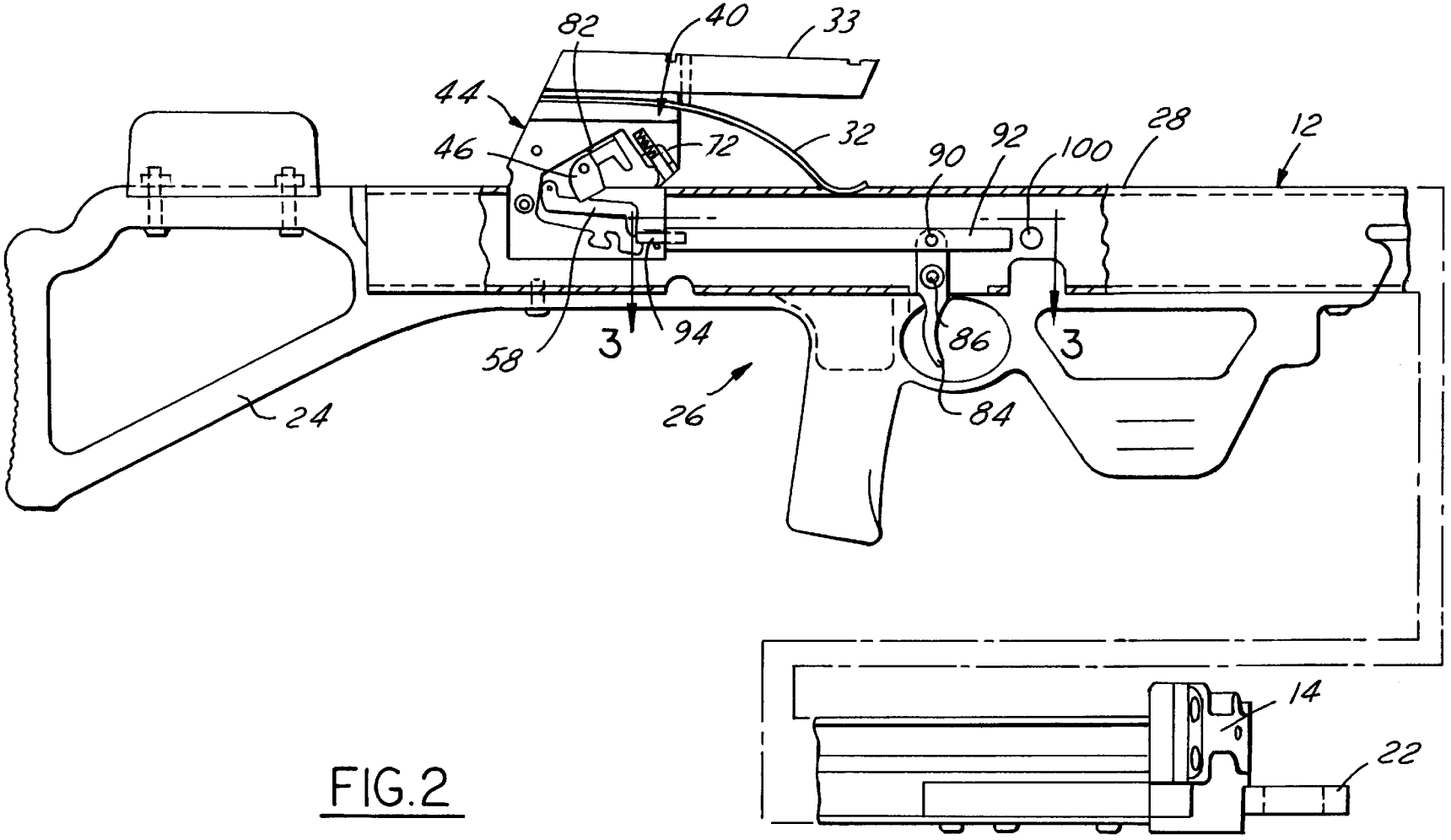
FIG. 2 is a fragmentary elevational view of the crossbow illustrated in FIG. 1.
Figure 4:
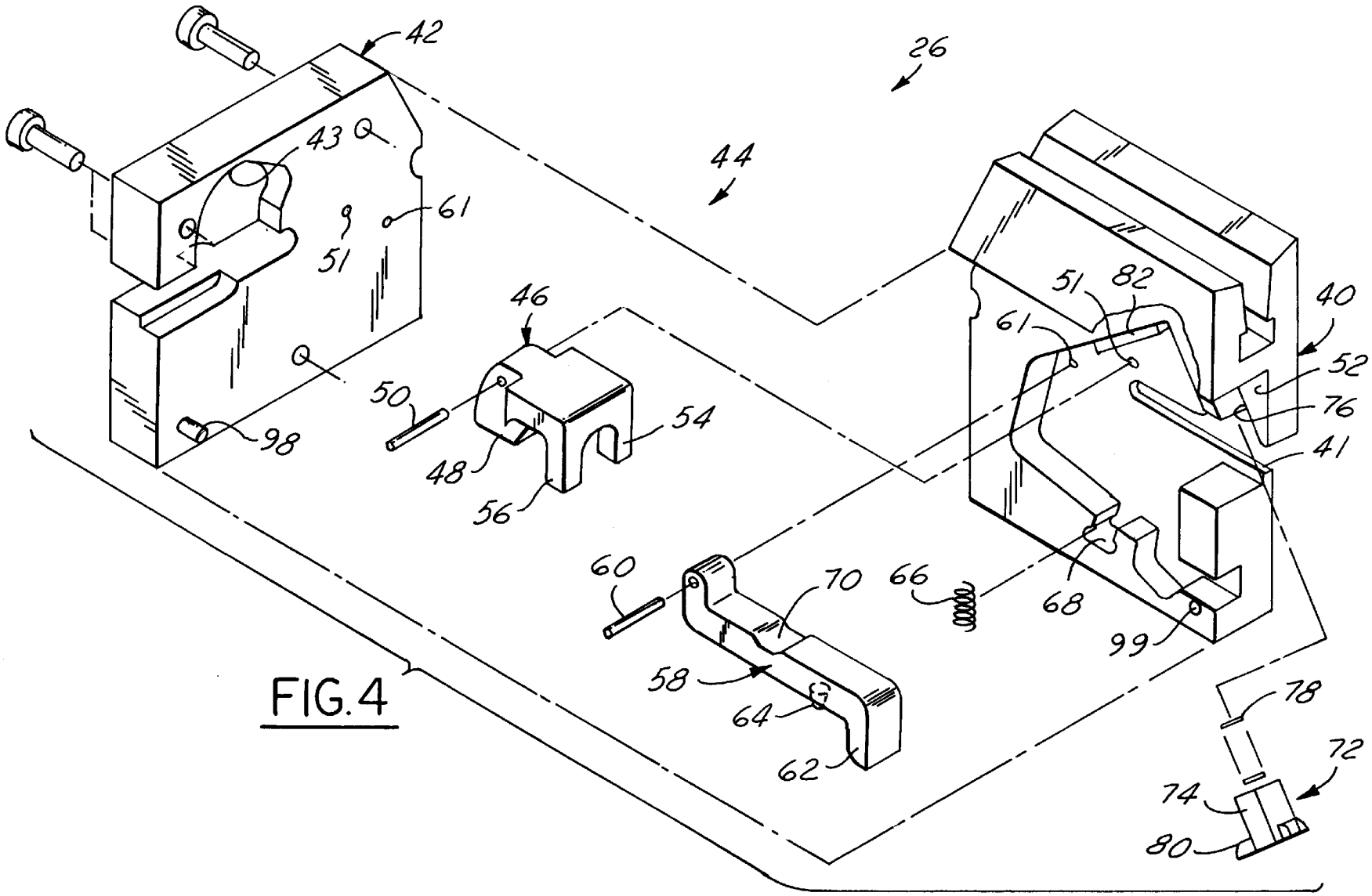
FIG. 4 is an exploded perspective view of the trigger housing assembly in the bow of FIGS. 1 and 2.

FIGS. 1 and 2 illustrate a crossbow 10 in accordance with a presently preferred embodiment of the invention as comprising an elongated barrel 12 having a base 14 at one end from which a pair of flexible limbs 16, 18 project in opposite lateral directions. The free ends of limbs 16, 18 are joined by a bowstring cable 20. An open bracket 22 is mounted on the end of base 14 for receipt of an operator's foot to assist in drawing cable 20 against the force of limbs 16, 18 to cock the bow. At the opposite end of barrel 12, there is disposed a butt 24 for placement against an operator's shoulder to stabilize the bow. The mid-portion of barrel 12 carries a trigger mechanism 26 for selectively capturing and releasing the bowstring cable. A guide 28 is carried on the upper surface of barrel 12 for slidably supporting a bolt for firing by the crossbow.

In general operation, bracket 22 is placed against the ground and the operator's foot is placed within the bracket so that cable 20 may be drawn against the force of limbs 16, 18. When cable 20 is fully drawn, it is captured by trigger mechanism 26. A bolt 30 (FIG. 5) is then positioned on guide 28 and inserted into the trigger mechanism for engagement with the drawn cable. An arcuate leaf spring 32 that extends from a sight bridge 33 helps hold the bolt against the opposing support surface provided by guide 28 so that the crossbow can be positioned and aimed by the operator. When trigger mechanism 26 is actuated by the operator, the bowstring cable is released so that the energy stored in arms 16, 18 propels bolt 30 from the bow.

Figure 5:
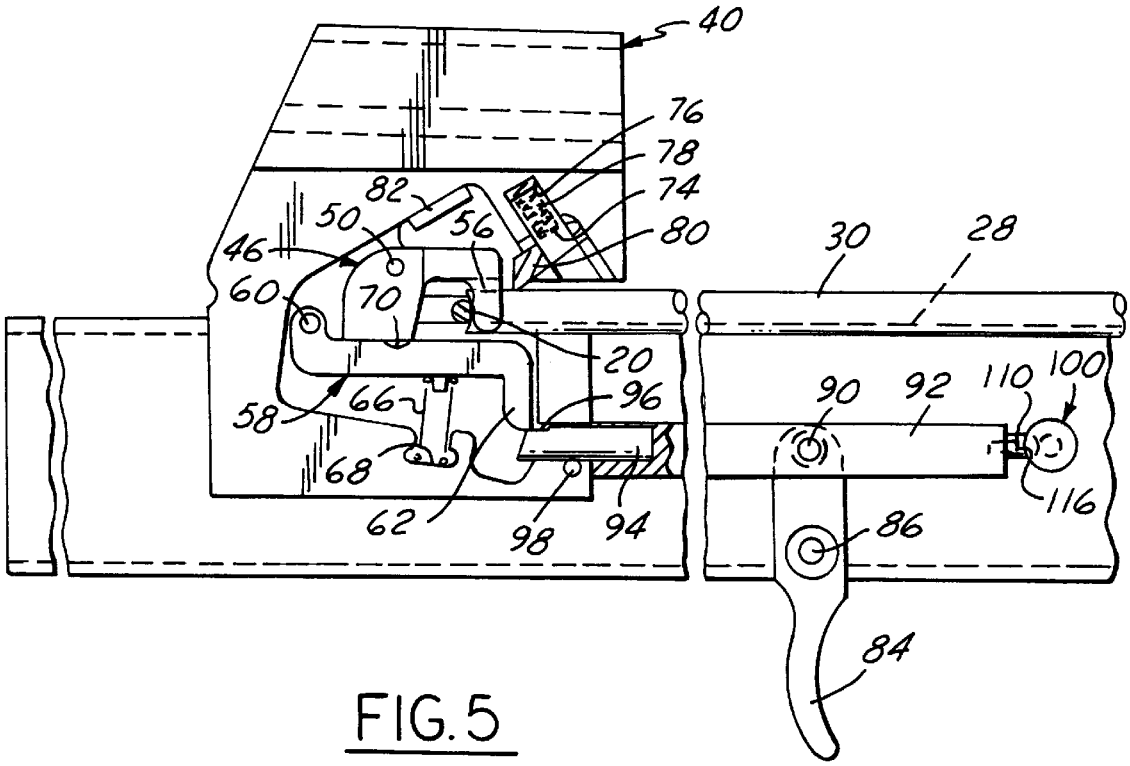
FIG. 5 is a partially sectioned and fragmentary elevational view of the trigger mechanism in the cocked position.

In accordance with the present invention, trigger mechanism 26 comprises a trigger housing 40 that cooperates with a cover plate 42 to form a housing assembly 44. Within the housing assembly, there is disposed a latch 46 that includes a base 48 pivotally carried by a pin 50 within the interior recess 52 of housing 40. The opposed ends of pin 50 are received in aligned openings 51 in housing 40 and plate 42. A pair of fingers 54, 56 project outwardly and downwardly from latch base 48, and are laterally spaced from each other so as to receive therebetween the rear end of a bolt 30 (FIG. 5). A latch release arm 58 is pivotally mounted at one end within cavity 52 by a pivot pin 60 beneath and adjacent to base 48 of latch 46. Pin 60 extends between openings 61 in housing 40 and plate 42. The opposing end of latch release arm 58 is downwardly turned at 62 for engagement by the trigger linkage, as will be described. The lower surface of arm 58 includes a nub 64 that is disposed in assembly within the coils of a spring 66. Spring 66 is captured in compression between arm 58 and a pocket 68 in the opposing surface of housing recess 52, such that latch release arm 58 is biased by spring 66 upwardly into opposed sliding engagement with body 48 of latch 46. The upper surface of latch release arm 58 includes a detent pocket 70 that cooperates with the opposing back comer of latch body 48 to hold the latch in the open position, as will be described.

A dry-fire safety mechanism 72 includes a block 74 slidably disposed within a pocket 76 that opens upwardly from recess 52 of trigger housing 40. A coil spring 78 is captured in compression between block 72 and the opposing surface of housing 40. A stop 80 extends downwardly from block 74. It will be noted in FIGS. 2, 5 and 6 that recess 76, block 74 and stop 80 are disposed at an angle to the guide surface of bolt support 28, for purposes to be described. The free end of stop 80 is angled so as to be approximately vertical in assembly for opposed engagement with bowstring cable 20, as will be described. A resilient pad 82 is carried by a surface of recess 52 in housing 40 for opposed abutment with latch 46 in the open upwardly pivoted position of the latter. Housing 40 and cover plate 42 have side openings 41, 43 to permit entry of the bowstring cable into assembly 44, and to permit viewing of the interior hardware.

Figure 3:
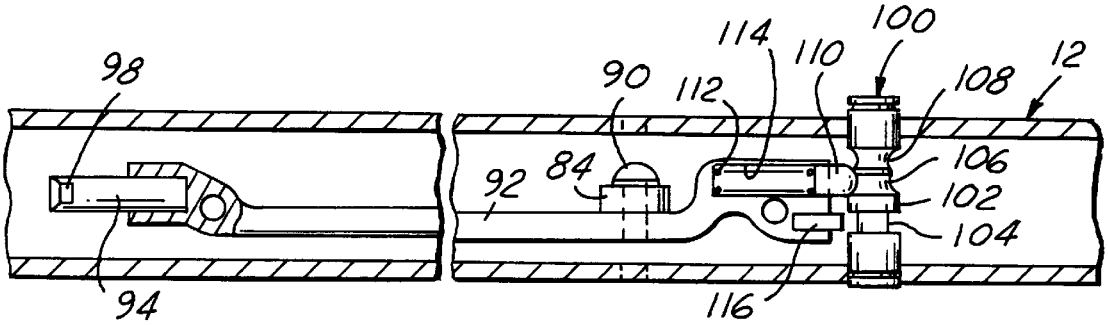
FIGS. 3 and 3A are fragmentary sectional views taken substantially along the line 3—3 in FIG. 2 showing operation of the trigger safety mechanism.
Figure 3A:
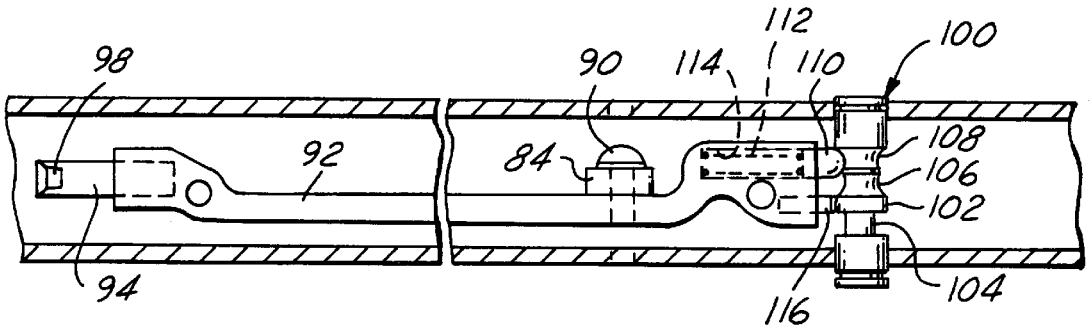

A trigger 84 is mounted on barrel 12 by a pivot pin 86 for selective engagement by an operator. The opposing end of trigger 84 is coupled by a pin 90 to a trigger linkage 92 that is carried for longitudinal movement within barrel 12 upon pivoting of trigger 84 about pin 86. A sear pin 94 of hardened steel or the like extends longitudinally from one end of linkage 92. A notch or recess 96 on sear pin 94 is positioned selectively to engage the downwardly turned end 62 of latch release arm 58. Sear pin 94 is slidably supported by a hardened steel pin 98 carried by trigger housing 40 between aligned openings 99 in housing 40 and plate 42. The opposing end of linkage 92 is disposed adjacent to a safety slide 100 that extends laterally across barrel 12. Safety slide 100 has a peripheral land 102 disposed adjacent to a slot 104, and a pair of adjacent concave slots 106, 108. A coil spring 112 is captured in compression within a recess 114 at the end of trigger linkage 92. A pin 110 is slidably received within recess 114, and has a rounded end or nose that is urged by coil spring 112 into recesses 106, 108 depending upon the position of slide 100 with respect to linkage 92. The end of linkage 92 also carries a fixed pin 116 for opposed alignment with either land 102 or channel 104 depending upon position of slide 100 in barrel 12. In use, safety slide 100 is positioned by an operator either in the safety position illustrated in FIG. 3A, in which pin 116 opposes land 102 and prevents forward motion of trigger linkage 92, or in the safety release position illustrated in FIG. 3 in which pin 116 is in opposed alignment with channel 104 so as to permit forward motion of linkage 92. Pin 10 is in continuous engagement with slide 100 and resiliently resists motion of slide 100, but with a force that can be readily overcome without excess pressure on the end of the safety slide. Thus, forces on the upper end of slide 100 in FIG. 3 causes pin 110 to ride out of slot 106 against the force of spring 112, and then to latch into slot 108. The opposite effect takes place upon application of force at the lower end of slide 100 in FIG. 3A.

Figure 6:
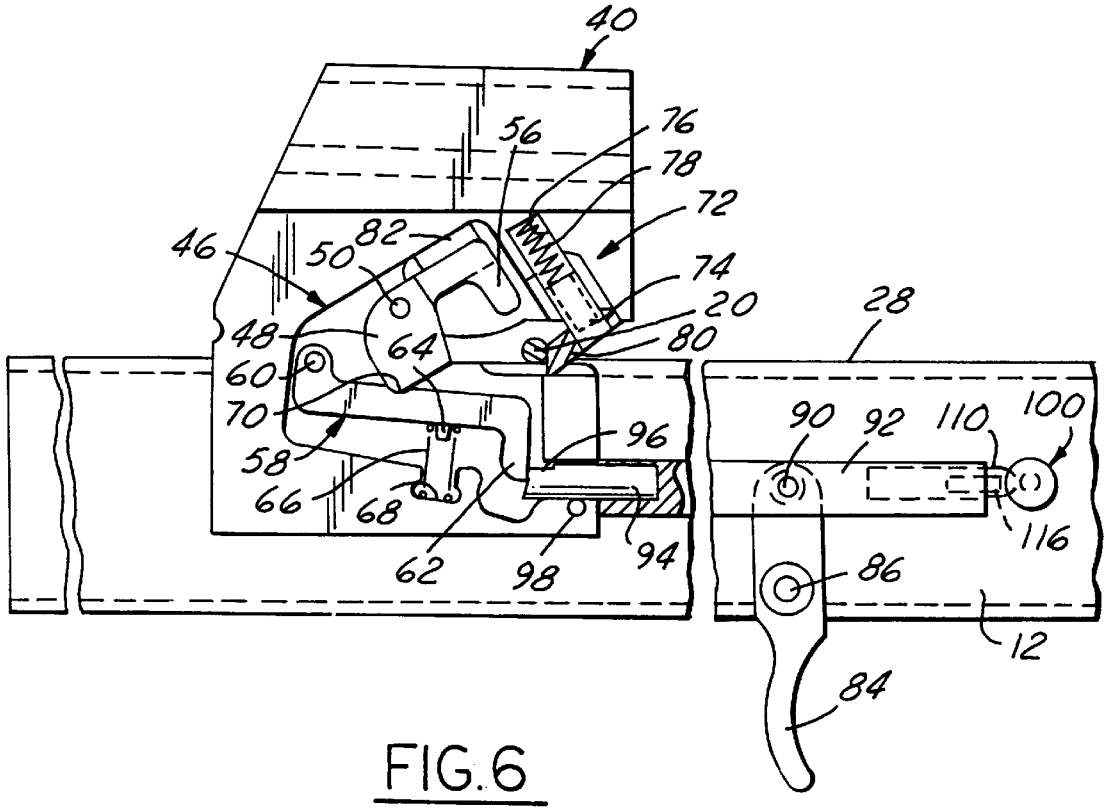
FIG. 6 is an elevational view similar to that of FIG. 5 but showing operation of the dry-fire safety upon release of the trigger mechanism.

The normal or uncocked position of the trigger mechanism is illustrated in FIG. 2. When bowstring cable 20 is drawn rearwardly by an operator to cock the bow, the bowstring cable first engages dry-fire safety 72. The angulated lower face of block 74 and stop 80 cooperate with the rearwardly moving cable to cam safety 72 upwardly against the force of coil spring 78. After the cable has cleared dry-fire safety 72 and entered trigger housing assembly 44, dry-fire safety 72 is again urged downwardly toward bolt support guideway 28 as illustrated in FIG. 6. Continued rearward drawing of bowstring cable 20 within housing assembly 44 brings cable 20 into engagement with latch body 48. Latch body 48 is disposed within pocket 70 of latch release arm 58, and spring 66 and latch release arm 58 hold latch 46 in the position pivoted upwardly against pad 82 (FIG. 6). When cable 20 engages latch body 48, continued pulling on the cable moves the latch body out of detent pocket 70, so that coil spring 66 urges latch release arm 58 upwardly and that the same time cable 20 pivots latch 46 downwardly until the latch and latch release assume the locked positions illustrated in FIG. 5. In this position, end 62 of latch release arm 58 is seated within recess 96 on sear 94 so as to prevent downward pivoting of the latch release arm. Cable 20 may now be released by the operator so that the same will engage the inside surfaces of latch fingers 54, 56. The crossbow is now cocked.

When a bolt 38 is positioned on supporting guideway 28 and moved rearwardly toward cable 20, the end of bolt 30 engages dry-fire safety 72 and cams the same upwardly against spring 78. Bolt 30 is then positioned between fingers 54, 56 in engagement with the drawn bowstring cable, and the bow is ready for firing. Dry-fire safety 72 is held in the upper position illustrated in FIG. 5 by sliding contact with bolt 30. With safety slide 100 in the position of FIG. 3, trigger 84 can now be pulled by an operator so as to move trigger linkage 92 and sear 94 from the position illustrated in FIG. 5 to that illustrated in FIG. 6. Movement of sear 94 out of engagement with end 62 of trigger release arm 58 permits latch 46 to be pivoted upwardly by the force applied thereto from cable 20. When latch fingers 54, 56 clear cable 20, cable 20 is released and propels bolt 30 longitudinally of the crossbow stock. Latch 46 pivots upwardly about pin 50 into abutment with pad 82. The rear edge of latch body 48 pushes latch release arm downwardly about pin 60 against the force of spring 66 until the latch body is seated within detent pocket 70. The trigger mechanism is now releasably locked in the open position.

In the event that cable 20 is drawn into trigger housing assembly 44 and captured by latch fingers 54, 56, but no bolt 30 is positioned on guideway 28, dry-fire safety 72 prevents undesirable firing of the bowstring cable in the event that the trigger mechanism is activated. Specifically, with no bolt 30 on the stock guideway, dry-fire safety 72 remains in the downward position illustrated in FIG. 6. In the event that the trigger mechanism is activated and cable 20 is released from latch 46, the cable will abut the end of stop 80 and further cable motion will be arrested. Safety body 74 and stop 80 are angulated as previously described to facilitate upward camming action as cable 20 and bolt 30 are inserted into the trigger housing. However, the angulated end of stop 80 abuts cable 20 and prevents upward camming of the stop mechanism by the cable as the cable moves forwardly.

There has thus been described a crossbow, and particularly an improved crossbow trigger mechanism, that fully satisfies all the objects and aims previously set forth. The trigger mechanism is characterized by a r educed number of component parts to improve economy of assembly and maintenance. The major portion of the trigger mechanism is contained within a housing that can be readily removed from the stock and/or repaired in situ. The action of the trigger mechanism is very smooth during both cocking and release. Safety mechanisms prevent both undesired operation of the trigger, and so-called dry release of the bowstring cable.

We claim:

1. In a crossbow that includes a barrel having a pair of limbs and a bowstring cable that extends between said limbs, a trigger mechanism for selectively capturing and releasing said cable against flexure of said limbs, and means for supporting a bolt when said cable is captured by said trigger mechanism, the improvement wherein said trigger mechanism comprises:

latch means mounted for pivoting between a closed position in which said latch means captures said cable and an open position for releasing said cable, latch release means mounted adjacent to and in opposed engagement with said latch means, said latch release means including means for engaging said latch means releasably to hold said latch means in both said open and said closed positions, a trigger movably mounted for engagement by an operator, and trigger linkage means operatively coupling said trigger to said latch release means and responsive to movement of said trigger by an operator to release said latch release means from holding said latch means in said closed position such that force of said cable on said latch means against flexure of said limbs pivots said latch means and said latch release means from said closed to said open position so as to release said cable.

2. The crossbow set forth in claim 1 further comprising safety means for engagement with said bowstring cable to prevent release of said bowstring cable by said trigger mechanism when a bolt is absent from said supporting means in engagement with said cable.

3. The crossbow set forth in claim 2 wherein said safety means comprises means carried adjacent to said latch means for motion toward and away from said supporting means at a position for engagement by a bolt on said supporting means so as to be positioned by such bolt to permit passage of the bowstring cable upon release of said latch means.

4. The crossbow set forth in claim 3 wherein said safety means includes spring means for urging said safety means to a position adjacent to said supporting means so as to block passage of said cable from said latch unless a bolt is positioned on said supporting means.

5. The crossbow set forth in claim 2 wherein said trigger mechanism comprises a trigger housing assembly, including said latch means, said latch release means and said safety means, mounted on said barrel.

6. The crossbow set forth in claim 5 wherein said safety means includes a spring mounted within said housing in engagement with said safety means for urging said safety means toward said supporting means.

7. The crossbow set forth in claim 5 further comprising a pad disposed within said housing adjacent to said latch means for abutment by said latch means in said open position of said latch means.

8. The crossbow set forth in claim 1 further comprising spring means in engagement with said latch release means for urging said latch release means toward said latch means.

9. The crossbow set forth in claim 8 wherein said means on said latch release means for engaging said latch release means comprises a detent pocket in said latch release means into which said latch means pivots such that said spring means and said latch release means hold said latch means in said open position.

10. The crossbow set forth in claim 1 wherein said latch means comprises a base pivotally mounted on said stock and a pair of fingers for releasably capturing said cable on opposed sides of a bolt carried by said supporting means.

11. The crossbow set forth in claim 10 wherein said latch release means comprises an arm pivotally mounted at one end and having an opposing end in engagement with said trigger linkage means, an upper surface of said arm being in sliding engagement with said base.

12. The crossbow set forth in claim 1 further comprising safety means in operational engagement with said trigger linkage means for selectively preventing motion of said linkage means and firing of the bow.

13. The crossbow set forth in claim 12 wherein said safety means comprising a safety slide carried by said barrel adjacent to an end of said trigger linkage means, said safety slide having a land for selective blocking abutment with said trigger linkage means.

14. The crossbow set forth in claim 13 wherein said trigger linkage means includes means for engagement with said slide for holding said safety slide in position.

15. In a crossbow that includes a barrel having a pair of limbs and a bowstring cable that extends between said limbs, a trigger mechanism for selectively capturing and releasing said cable against flexure of said limbs, and means for supporting a bolt when said cable is captured by said trigger mechanism, the improvement comprising:

a trigger movably mounted on said barrel at a position spaced from said trigger mechanism between said mechanism and said limbs, trigger linkage means extending from said trigger to said trigger mechanism such that movement of said trigger by an operator releases said trigger mechanism, and safety means mounted on said barrel adjacent to said trigger at a position for operative engagement with said trigger linkage means for selectively preventing motion of the trigger linkage means and firing of the bow.

16. The crossbow set forth in claim 15 wherein said safety means comprising a safety slide carried by said barrel adjacent to an end of said trigger linkage means, said safety slide having a land for selective blocking abutment with said trigger linkage means.

17. The crossbow set forth in claim 16 wherein said trigger linkage means includes means for engagement with said slide for holding said safety slide in position.

18. The crossbow set forth in claim 17 wherein said holding means comprises a pair of concave channels in said slide adjacent to each other, a pin carried by said linkage means with a convex nose disposed to nest in said channels, and a spring on said linkage means biasing said nose into abutting engagement with said channels.

* * * * *